US010214309B2

(12) United States Patent
Goettke

(10) Patent No.: US 10,214,309 B2
(45) Date of Patent: Feb. 26, 2019

(54) PLASTIC TUBE DESIGNED FOR PRESSING OUT A LIQUID TO PASTY MASS

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/512,172

(22) PCT Filed: Sep. 24, 2014

(86) PCT No.: PCT/EP2014/070348

§ 371 (c)(1),
(2) Date: Mar. 17, 2017

(87) PCT Pub. No.: WO2016/045720

PCT Pub. Date: Mar. 31, 2016

(65) Prior Publication Data

US 2017/0275038 A1 Sep. 28, 2017

(51) Int. Cl.

| | |
|---|---|
| ***B65B 69/00*** | (2006.01) |
| ***B65D 35/08*** | (2006.01) |
| ***B65D 35/38*** | (2006.01) |
| ***B65D 47/06*** | (2006.01) |
| ***B65D 47/26*** | (2006.01) |
| ***B65D 83/00*** | (2006.01) |

(52) U.S. Cl.

CPC ..... *B65B 69/005* (2013.01); *B65D 35/08* (2013.01); *B65D 35/38* (2013.01); *B65D 47/063* (2013.01); *B65D 47/263* (2013.01); *B65D 83/0022* (2013.01)

(58) Field of Classification Search

CPC .... B65D 35/08; B65D 35/38; B65D 83/0022; B65D 47/063; B65D 47/263; B65B 69/005

See application file for complete search history.

(56) References Cited

U.S. PATENT DOCUMENTS 1,548,118 A * 8/1925 Densmore ..... B65D 47/242 222/521
2,297,690 A * 10/1942 Nitardy ..... B65D 35/14 222/129
2,516,040 A * 7/1950 Zumdahl ..... B65D 35/38 215/307

(Continued)

OTHER PUBLICATIONS

International Search Report of PCT/EP2014/070348, dated May 8, 2015.

(Continued)

*Primary Examiner* — Frederick C Nicolas
(74) *Attorney, Agent, or Firm* — Collard & Roe, P.C.

(57) ABSTRACT

A plastic tube designed for pressing out a liquid to pasty mass has a discharge opening, a supply space designed to be compressed, and a tube neck, which connects the supply space to the discharge opening, wherein a mass line having a line cross-section through which mass can flow extends through the tube neck, which cannot be used to press out the mass by means of a manual force of a user. The tube neck is designed, with regard to a free space that can be filled with mass as mass is pressed out, in such a way that a volume of the mass located in the tube neck during the pressing out corresponds to a third or less of a volume that is given by the dimensions of the tube neck.

20 Claims, 9 Drawing Sheets

(56) References Cited

U.S. PATENT DOCUMENTS

| | | | | |
|---|---|---|---|---|
| 3,433,394 | A | 3/1969 | Stull | |
| 3,777,939 | A | 12/1973 | Moore | |
| 4,846,380 | A * | 7/1989 | Giuseppe | B65D 25/44 222/519 |
| 5,097,994 | A * | 3/1992 | Washam | B65D 47/063 222/527 |
| 6,536,631 | B1 * | 3/2003 | Nickels | B65D 47/2018 222/212 |
| 6,695,173 | B1 * | 2/2004 | Fontana | B65D 47/2068 222/206 |
| 7,306,129 | B2 * | 12/2007 | Swiss | B65D 47/205 137/853 |
| 7,874,467 | B2 * | 1/2011 | Pardes | A61F 9/0008 222/494 |
| 7,997,460 | B2 * | 8/2011 | Pardes | B65D 47/205 137/853 |
| 8,231,033 | B2 * | 7/2012 | Webb | A61L 2/26 222/148 |
| 8,863,998 | B2 * | 10/2014 | Painchaud | B65D 47/2031 222/494 |
| 2016/0368668 | A1 * | 12/2016 | King | B65D 35/22 |

OTHER PUBLICATIONS

Response dated Jul. 20, 2016 from the European patent attorney to the European Patent Office regarding PCT/EP2014/070348 with an English translation of the relevant parts.

* cited by examiner

PLASTIC TUBE DESIGNED FOR PRESSING OUT A LIQUID TO PASTY MASS

CROSS REFERENCE TO RELATED APPLICATIONS

This application is the National Stage of PCT/EP2014/070348 filed on Sep. 24, 2014, the disclosure of which is incorporated by reference. The international application under PCT article 21(2) was not published in English.

The invention pertains to a plastic tube designed for pressing out a liquid to pasty mass with a discharge opening, a reservoir designed for being compressed and a tube neck connecting the reservoir to the discharge opening, wherein a mass line with a line cross section, through which the mass can flow, extends through the tube neck, which cannot be used for pressing out the mass by means of the manual force of a user.

BACKGROUND OF THE INVENTION

Plastic tubes of the type in question are generally known. These plastic tubes serve, for example, for administering topically applied medicines in liquid or pasty form. In this context, there also exist plastic tubes for the topical application on animals, wherein the medicine is applied on the skin of the animal. For these types of applications, it is furthermore known to design the tube neck comparatively long in order to penetrate the coat of the animal therewith.

The application is realized due to the compression of the reservoir by means of the manual force of a user, wherein the mass, which is initially located in the reservoir, is pressed out through the discharge opening via the mass line of the tube neck.

In contrast to the reservoir, the tube neck is designed rigidly and, in particular, cannot be compressed by means of the manual force of a user such that the tube neck can be used in the form of an application tube. A residual amount of mass remains in the tube neck after the mass has been pressed out of the reservoir.

SUMMARY OF THE INVENTION

In light of the relevant prior art, the technical objective of the invention can be seen in enhancing a plastic tube of the type in question in such a way that the residual amount of mass remaining in the tube neck is minimized after the mass has been pressed out of the reservoir.

According to a first aspect of the invention, this objective is attained with a plastic tube, in which the tube neck is with respect to a free space, which can be filled with the mass while it is pressed out, designed such that a volume of the mass located in the tube neck while the mass is pressed out corresponds to one-third or less of the volume defined by the dimensions of the tube neck.

The proposed design minimizes the residual amount of mass remaining in the region of the tube neck after the mass has been pressed out of the reservoir. The space in the tube neck, which can be filled with the mass, is significantly reduced in comparison with a neck volume that is defined, in particular, by the inside cross section of the outer wall of the tube neck. The line cross section, through which the mass flows, preferably corresponds to less than two-thirds of the clear inside cross section of the outer wall or to half or less of a cross-sectional area defined by an outer surface of the outer wall. The volume of the mass located in the tube neck preferably lies between one-sixth and one-twentieth of the volume defined by the tube neck wall only.

This cross-sectional reduction preferably extends over the entire length of the tube neck, wherein the mass essentially moves toward the discharge opening through the tube neck in the longitudinal direction thereof.

In comparison with a conventional tube neck, in which the tube neck has a constant outside cross section, the residual quantity remaining in the tube neck is thereby reduced and it is simultaneously ensured that the tube neck still has sufficient stability.

The cross section of the mass line accommodating the mass may be constant in the longitudinal direction of the tube neck or alternatively vary, for example, in a successively decreasing or increasing fashion.

The tube neck may feature a free space, which extends in the direction of the longitudinal axis and is not infiltrated by the mass. This free space may extend centrally of the tube neck referred to a cross section, i.e. a section transverse to the longitudinal direction. However, an eccentric arrangement of the free space is also conceivable. The free space is designed and arranged in such a way that it can neither be infiltrated by the mass while or after the tube is filled with mass nor during the mass discharge.

One or more mass lines may be provided, wherein the line cross section is in an embodiment with multiple mass lines formed by the sum of these mass lines. The one or more mass lines preferably extend in the longitudinal direction toward the free space, which is not infiltrated by the mass, for example such that they extend laterally thereof.

The one or more mass lines are—viewed in a cross section—preferably arranged on an annular surface. This annular surface preferably surrounds the free space, which is not infiltrated by the mass, such that the respective mass line or line cross section preferably is arranged outside the longitudinal center axis of the tube neck only.

The discharge opening may feature one or more dispensing apertures. In this respect, it is preferred to provide two, three or more dispensing apertures, for example four or six dispensing apertures. The number of dispensing apertures may correspond to the number of mass lines. If only one dispensing aperture is provided, it may be realized with an annular cross section, particularly such that it surrounds the free space, which is not infiltrated by the mass. In an embodiment with a plurality of dispensing apertures, these dispensing apertures are preferably arranged in an annular surface.

A mounting projection extending in the mass transport direction may be formed in the tube neck. This mounting projection preferably extends in the longitudinal direction of the tube neck. It may consist of a projection for a clip-on or snap-on mounting or alternatively for a screw mounting.

The mounting projection is preferably arranged on the side of the discharge opening, i.e. in the end of the tube neck facing away from the reservoir.

Furthermore, the mounting projection can preferably be realized integrally with the tube neck, i.e. in one piece consisting of the same material.

In an embodiment, the tube neck is realized such that it can be assembled of multiple parts. The assembly takes place before the plastic tube is filled with the mass. The free space, which cannot be infiltrated by the mass, is created in the tube neck due to the assembly.

It is furthermore preferred that an insert part is arranged in the tube neck in order to form a mass line. The insert part may have a cross section that is adapted to the cross section of the tube neck. For example, a circular insert part is preferably provided if the tube neck has a circular cross section. If the tube neck has a tubular design with a circular cross section, the insert part is simultaneously realized in the form of a tube with reduced cross section, if applicable in the form of a solid body with circular cross section. However, the insert part may altogether also consist of a hollow body, particularly an elongated circular-cylindrical hollow body.

The insert part may be mounted on the mounting projection on the side of the discharge opening. This mounting is preferably realized in such a way that it cannot be disengaged in the operative state of the tube without damaging the tube.

On the side of the reservoir, the insert part preferably features a mounting projection for cooperating with the corresponding end of the tube neck and/or with a facing region of the reservoir.

The insert part is preferably mounted in the plastic tube on both ends in order to fix the insert part within the tube.

The mounting projection on the side of the insert part may be designed for a clamp-type mounting in the tube neck. However, a screw mounting may also be realized.

In addition, the end of the insert part facing the discharge opening can be mounted while the tube is closed after it has been filled with the mass. After the reservoir has been filled with the mass, for example, the tube is closed by welding the tube bottom, wherein the facing free end of the insert part can be taken hold of during the course of said welding process in order to fix the insert part by welding it to the tube material.

In an embodiment, the insert part extends within the tube neck only. In this case, the free end of the insert part pointing in the direction of the reservoir is preferably mounted on the tube neck by means of a mounting projection. In this embodiment, the insert part does not extend into the reservoir or only insignificantly extend into the reservoir, i.e. by no more than one-fifth or one-tenth of the length.

It is alternatively proposed that the insert part extends within the tube neck, as well as within the reservoir. In this case, the insert part may furthermore extend as far as a bottom region of the reservoir, for example into a welded region for closing the tube bottom. The insert part may also be realized integrally with the tube neck, preferably in one piece consisting of the same material. On the side of the discharge opening, the insert part may be connected to the tube neck such that one or more dispensing apertures remain.

The reservoir has a longitudinal center axis. This axis preferably coincides with a longitudinal center axis of the tube neck. Furthermore, the longitudinal center axis of the reservoir preferably also coincides with the longitudinal center axis of the insert part.

A length of the tube neck in the direction of the longitudinal center axis is preferably equal to or greater than a longitudinal center axis of the reservoir. For example, the length of the tube neck or its longitudinal center axis preferably corresponds to 1.2-times to 3-times, particularly about 2-times to 2.5-times, the length of the longitudinal center axis of the reservoir, particularly of the usable reservoir after the tube has been closed.

The tube neck preferably has a greater wall thickness than the reservoir. In this way, the tube neck has a greater stability than the reservoir, particularly a greater buckling stability. Furthermore, the tube wall thereby maintains its elastic resilience whereas the tube neck wall preferably cannot be compressed by means of the manual force of a user—at least without particularly great effort.

If applicable, the reservoir may furthermore be free of fixtures except for a section of the insert part.

Due to the volume reduction in the tube neck, the remaining residual mass can be reduced to 50 to 15% of the overall filling mass. In a tube neck without volume reduction, the proportion of the residual mass lies above 50%, for example at 70%, of the overall mass. The proposed solution makes it possible to fill the tube with a smaller amount of mass, but to still discharge the same amount of mass.

With respect to the disclosure, the ranges and value ranges or multi-ranges specified above and below also include all intermediate values, particularly in 1/10 increments of the respective dimension or, if applicable, also dimensionless. For example, the specification 1.2-times to 3-times also includes the disclosure of 1.3-times to 3-times, 1.2-times to 2.9-times, 1.3-times to 2.9-times, 1.9-times to 2.3-times, etc., the specification 50 to 15% also includes the disclosure of 50.1 to 15%, 50 to 14.9%, 50.1 to 14.9%, 23.4 to 38.2%, etc., and the specification of a ratio of 1.2:1 also includes the disclosure of 1.3:1, 1.2:0.9, 1.3:0.9, 1.5:0.7, etc. This disclosure may on the one hand serve for defining one of the aforementioned upper and/or lower range limits, but alternatively or additionally also for disclosing one or more singular values from a respectively specified range.

BRIEF DESCRIPTION OF THE DRAWINGS

The invention is described in greater detail below with reference to the attached drawings, which merely show exemplary embodiments. A component, which is only described with reference to one of the exemplary embodiments and not replaced with another component in another exemplary embodiment, is therefore also described as a potentially existing component in this other exemplary embodiment. In the drawings:

FIG. 7 shows an enlarged view of the region VII in FIG. 6;

DETAILED DESCRIPTION OF THE EMBODIMENTS

Figure 1:
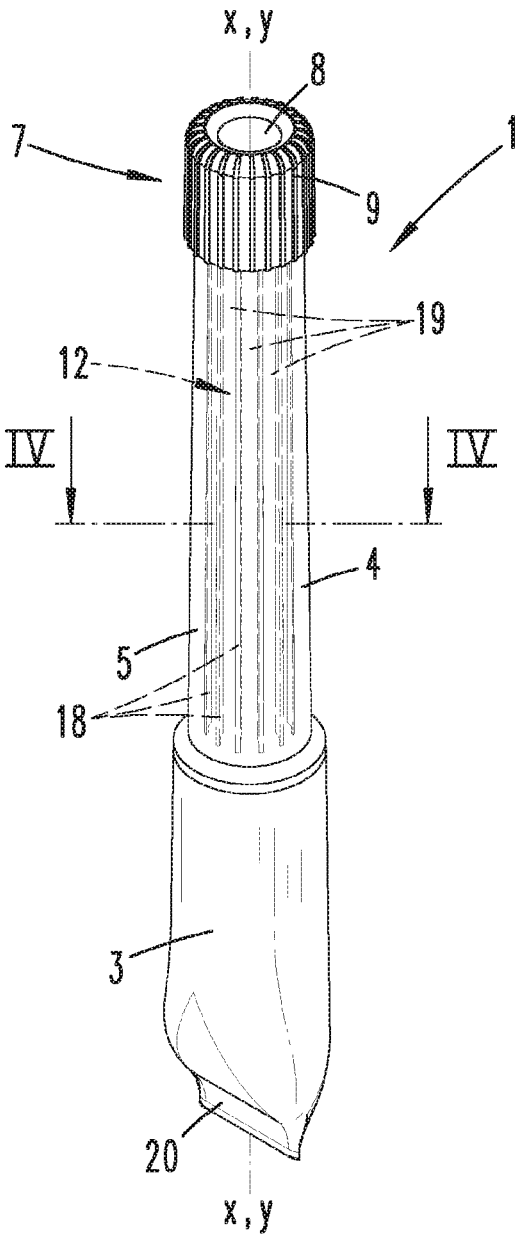
FIG. 1 shows a perspective view of a first embodiment of a plastic tube.
Figure 2:
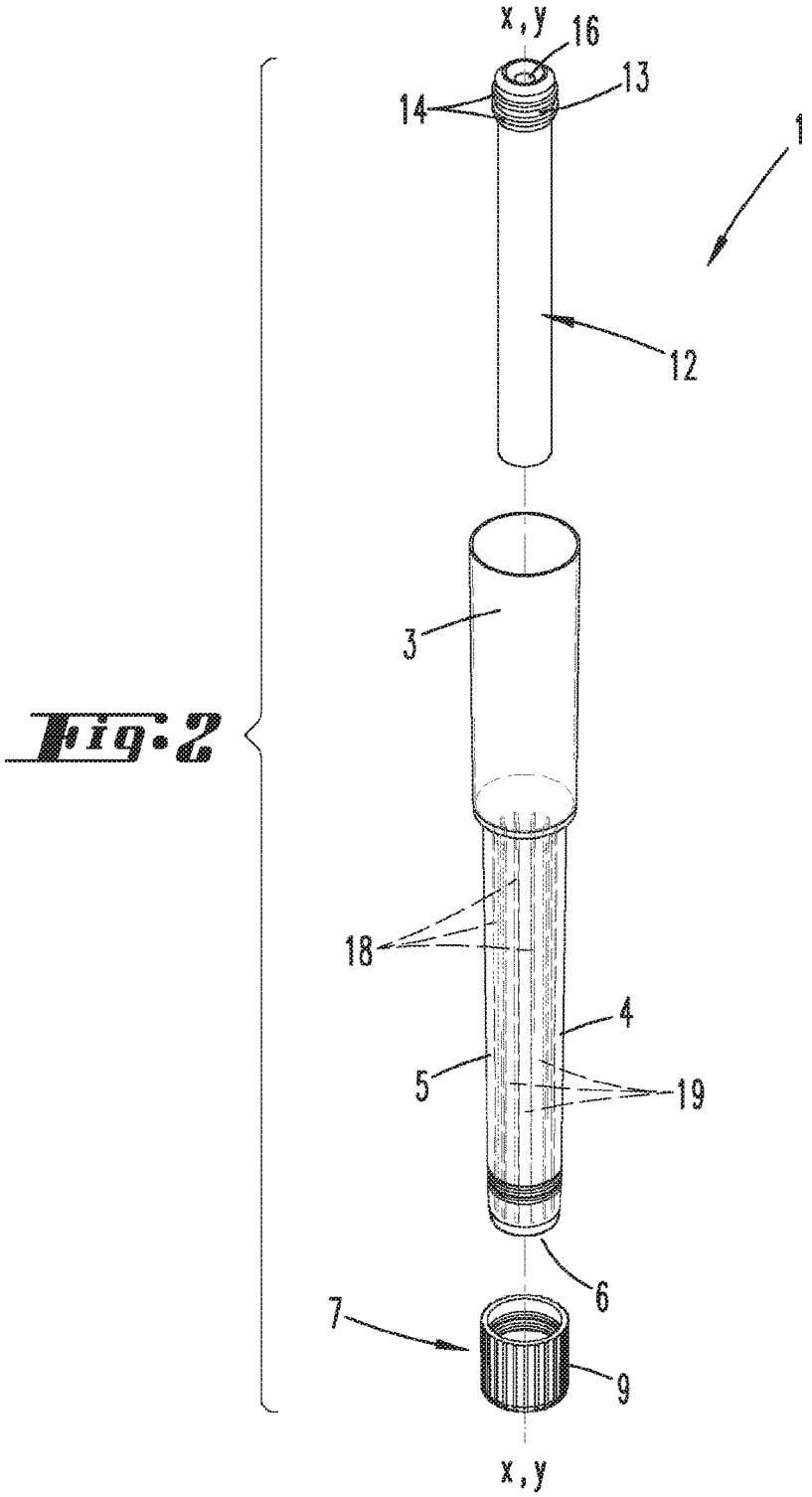
FIG. 2 shows a perspective exploded view of the plastic tube before a reservoir of the plastic tube is filled and closed.
Figure 3:
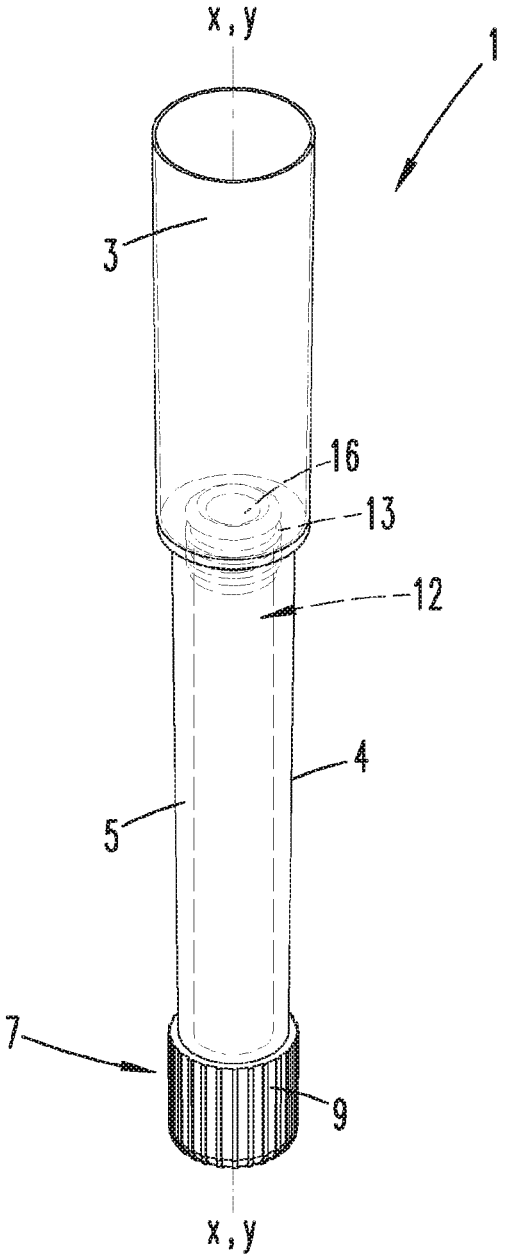
FIG. 3 shows the assembled plastic tube before it is filled and closed.
Figure 4:
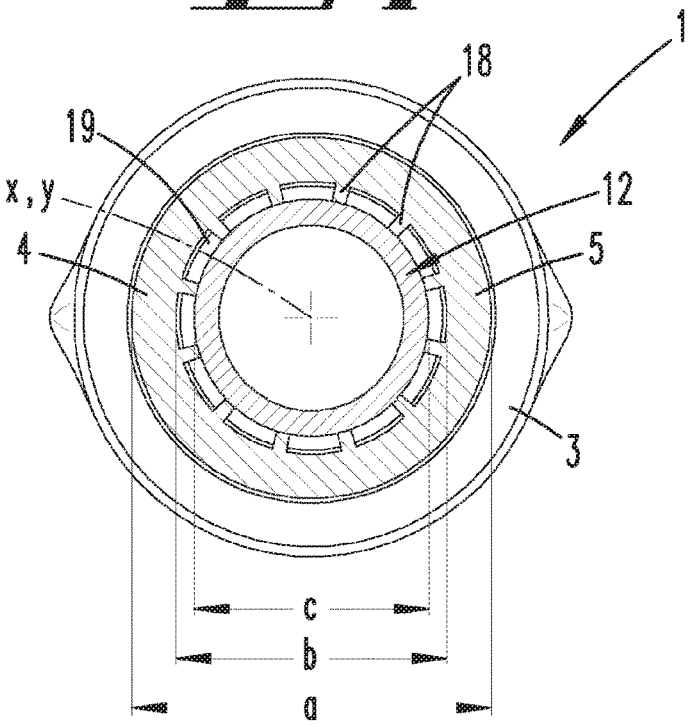
FIG. 4 shows an enlarged section along the line IV-IV in FIG. 1.
Figure 5:
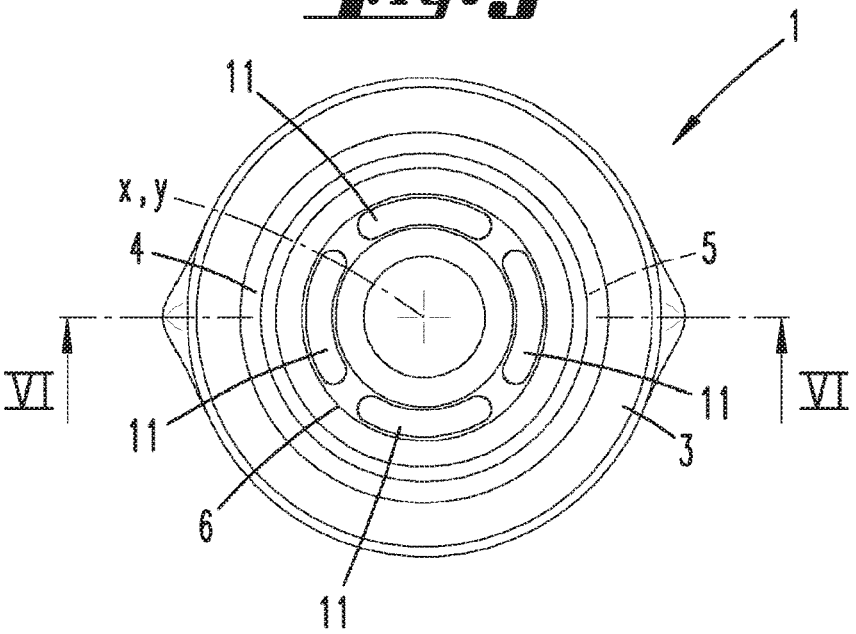
FIG. 5 shows a top view of the region of a discharge opening of the plastic tube in the direction of the arrow V in FIG. 6.
Figure 6:
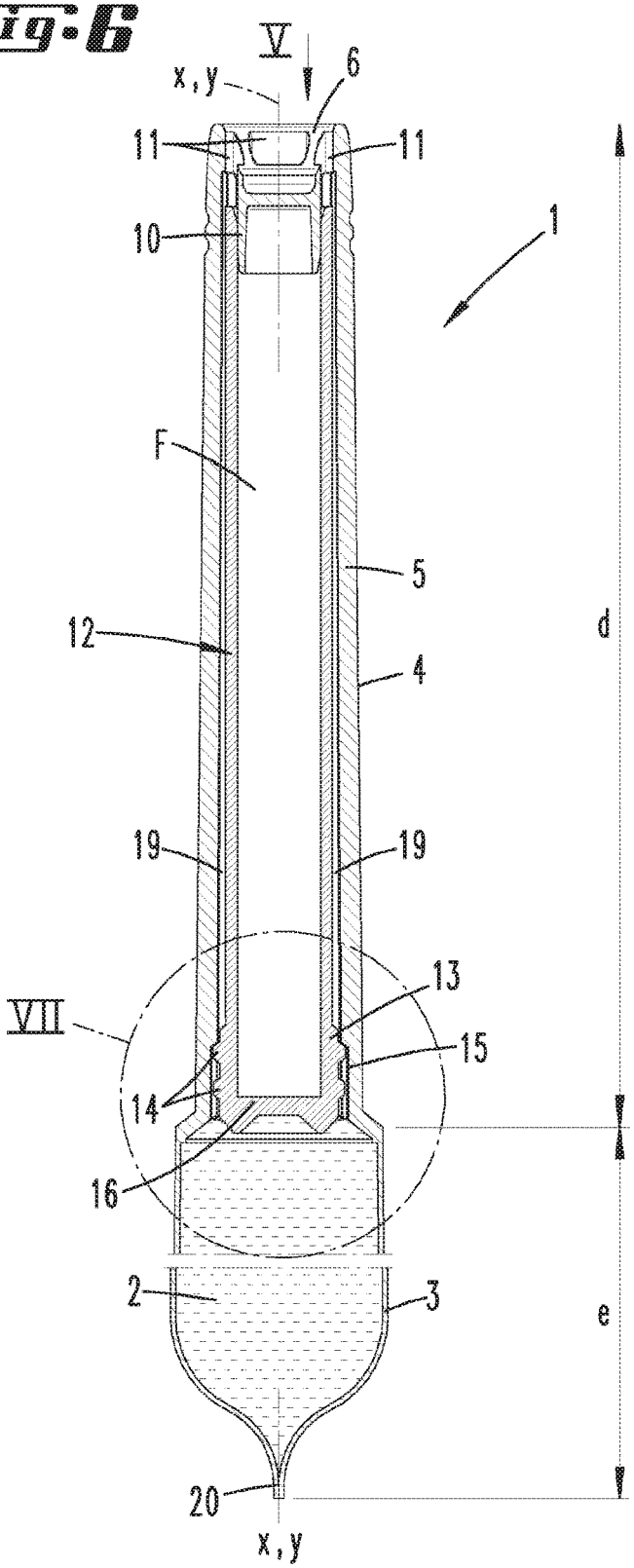
FIG. 6 shows a longitudinal section through the filled and closed reservoir of the plastic tube along the line VI-VI in FIG. 5.
Figure 8:
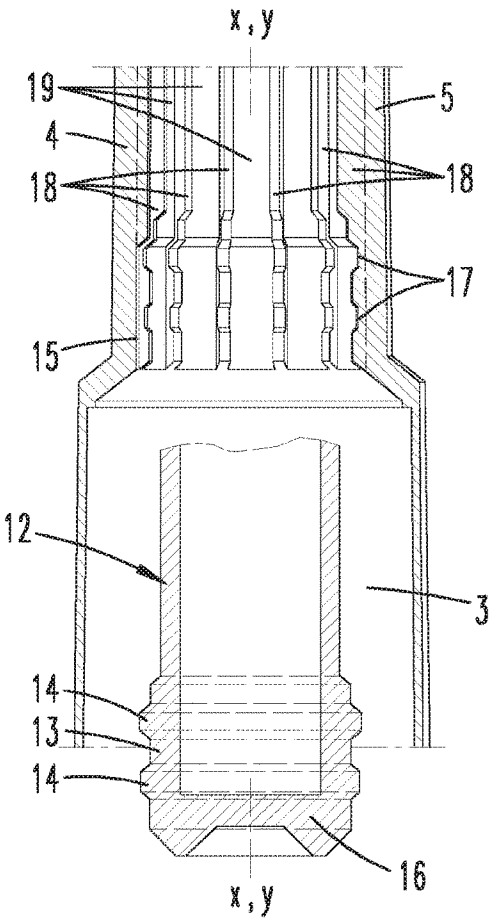
FIG. 8 shows the region according to FIG. 7, however, in the form of an exploded view.

A plastic tube 1 designed for pressing out a liquid to pasty mass 2 from a reservoir 3 is initially described below with reference to FIG. 1.

The reservoir 3 is elastically resilient and accordingly designed for being compressed in order to discharge the mass 2.

A tube neck 4 is connected to the reservoir 3. This tube neck essentially has an elongated, circular-cylindrical design, wherein the tube neck preferably is conically tapered from the reservoir 3 toward the end facing away from the reservoir 3.

The tube neck 4 and the reservoir 3 are preferably realized integrally and consist of the same material, wherein the wall 5 of the tube neck 4 has a greater wall thickness than the wall of the reservoir 3. For example, the wall 5 of the tube neck 4 has a thickness, which is approximately 4-times to 5-times greater than that of the reservoir wall.

The tube neck 4 has—measured along a longitudinal center axis—a length d, which approximately corresponds to 1.2-times to 2-times, particularly about 1.5-times, the length e of the reservoir 3.

The tube neck 4 has a longitudinal center axis x and the reservoir 3 has a longitudinal center axis y. Both longitudinal center axes x and y preferably coincide.

The tube neck 4 connects the reservoir 3 to a discharge opening 6 arranged on the end of the tube neck 4.

While the plastic tube 1 is not in use, the end of the tube neck on the discharge side is covered by a cap 7. In the closed position, this cap covers the discharge opening 6, which is essentially aligned transverse to the longitudinal center axis x, by means of a cap top 8. The cap wall 9 encompasses the tube neck end on the outer side of the tube neck wall. The cap 7 is preferably fixed by means of a screw mounting.

A ratio of the tube neck outside diameter a to the tube neck inside diameter b may lie between 1.2:1 and 1.5:1, particularly at about 1.3:1.

The tube neck 4 has a high buckling stability due to the chosen wall thickness thereof. Furthermore, the tube neck 4 cannot be compressed by means of the normal manual force of a user.

A mounting projection 10, which is aligned concentric to the longitudinal center axis x and points into the interior of the tube neck 4, is integrally formed on the tube neck 4 on the side of the discharge opening. The outer side of its wall extends with radial clearance from the inner surface of the tube neck 4.

In the exemplary embodiment shown, four dispensing apertures 11, which are respectively realized in the form of a an annular segment, are uniformly distributed around the longitudinal center axis x in the transition area between the mounting projection 10 and the corresponding end section of the tube neck 4 on the side of the discharge opening. These dispensing apertures connect the discharge opening 6 to the annular space remaining between the outer wall of the mounting projection and the inner wall of the tube neck.

A volume-reducing insert part 12 is accommodated in the tube neck 4. According to the embodiment illustrated in FIGS. 1-10, this insert part may be realized in the form of a separate part that is assigned to the tube neck 4. Accordingly, the tube neck 4 is realized such that it can be assembled of multiple parts.

The insert part 12 is essentially realized in the form of an elongated hollow cylinder with an outside diameter c, which corresponds to 0.6-times to 0.9-times the inside diameter b of the tube neck 4.

The insert part 12 is aligned concentric to the longitudinal center axis x of the tube neck 4 and mounted on the mounting projection 10 with its end facing the discharge opening 6.

The mounting projection 10 penetrates into the tubular insert part 12 such that the wall of the mounting projection is supported on the inner side of the wall of the insert part 12 in a sealed fashion.

The insert part 12 preferably ends with axial clearance from the dispensing apertures 11 such that a section of the annular space remains between the mounting projection 10 and the inner wall of the tube neck 4.

On the side facing away from the mounting projection 10, the insert part 12 forms a mounting projection 13 on the outer side of its wall. This mounting projection is essentially formed by two radially protruding annular ribs 14, which are spaced apart from one another in the axial direction.

The annular ribs 14 engage into a localization area 15, which is radially enlarged in comparison with the inside diameter b of the tube neck 4 in the transition area from the tube neck 4 to the reservoir 3.

The tubular insert part 12 is closed in the direction of the reservoir 3 by means of a bottom 16. This bottom 16 essentially extends transverse to the longitudinal center axis x of the tube neck 4, preferably in the transition area from the tube neck 4 to the reservoir 3.

In the localization area 15, the annular ribs 14 engage into correspondingly positioned and designed annular depressions 17.

The installation of the insert part 12 takes place from the side of the reservoir, wherein the bottom of said reservoir 3 is initially open for fitting and filling purposes.

The insert part 12 is inserted into the tube neck 4 and then captively held on the tube neck 4 due to the interaction between the annular ribs 14 and the annular depressions 17.

Due to the design of the insert part 12 in the form of a hollow profile, a central free space F extending in the axial direction is formed in the installed state, wherein said free space is closed relative to the surroundings, through which the mass flows.

The insert part 12 is centered by means of a rib-like support thereof. On the inner side of its wall, the tube neck 4 features multiple ribs 18, which are directed radially inward and uniformly distributed over the circumference, in order to support the outer wall of the insert part 12.

Mass lines 19, which are essentially aligned along the longitudinal center axis x, are consequently formed between the ribs 18. In the exemplary embodiment shown, twelve mass lines 19 are formed outside the longitudinal center axis x and in an annular surface between the insert part 12 and the tube neck 4 referred to a cross section according to FIG. 4.

The clear flow diameter of the tube neck 4 and therefore its clear volume, through which the mass can flow, are reduced due to the arrangement of the insert part 12. Consequently, a fillable space, which is essentially defined by the mass lines 19 and corresponds to one-sixth to one-tenth, preferably about one-eighth, of the volume defined by the tube neck 4 only without consideration of the insert part 12, is formed between the tube neck 4 and the insert part 12.

In another preferred embodiment, the volumetric capacity in the cross-sectionally reduced tube neck region is—based on a volume of approximately 10.61 ml without an insert part 12—reduced to 1.35 ml or 3.35 ml by inserting the insert part 12.

In an embodiment, the mass lines 19 have the same circumferential lengths and/or radial depths over their entire axial length. The sectional view in FIG. 6, in particular, shows that the radial depth of each mass line 19 may—starting from the engagement of the insert part 12 in the transition area from the tube neck 4 to the reservoir 3—be reduced in the direction of the discharge opening 6, for example, as far as a radial dimension corresponding to half of the maximum radial dimension of a mass line 19.

Once the tube neck 4 has been fitted with the insert part 12, the plastic tube 1 is ready to be filled with the mass 2. This takes place in an upside-down position of the plastic tube according to the illustration in FIG. 3.

After the filling process, the region of the reservoir 3 facing away from the tube neck 4 is closed by means of welding. The welded region 20 preferably includes the longitudinal center axis y of the reservoir 3.

Due to the insert part 12, the residual volume remaining in the tube neck after the mass 2 has been discharged from the reservoir 3 is significantly reduced in comparison with a tube neck 4 of identical dimensions without an insert part 12, wherein it is simultaneously ensured that the tube neck 4 still has the required stability.

Figure 9:
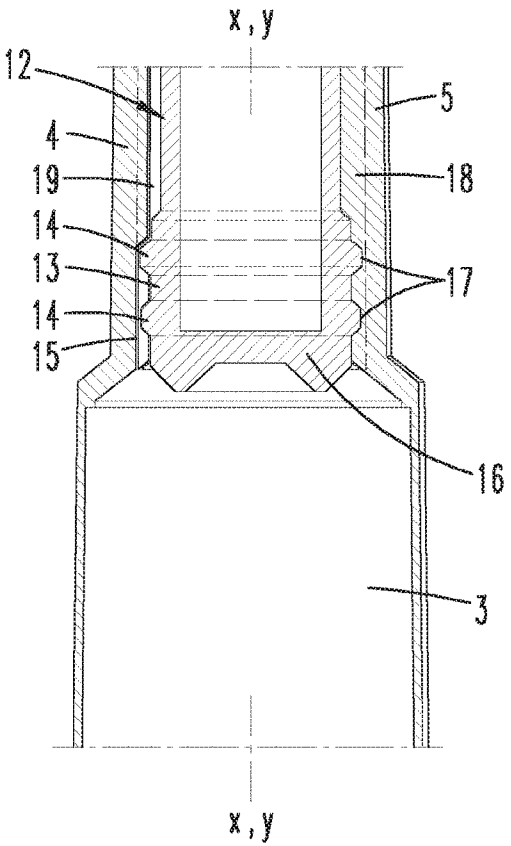
FIG. 9 shows an intermediate position during the discharge of the mass from the reservoir in the form of an illustration that essentially corresponds to FIG. 6.
Figure 9:
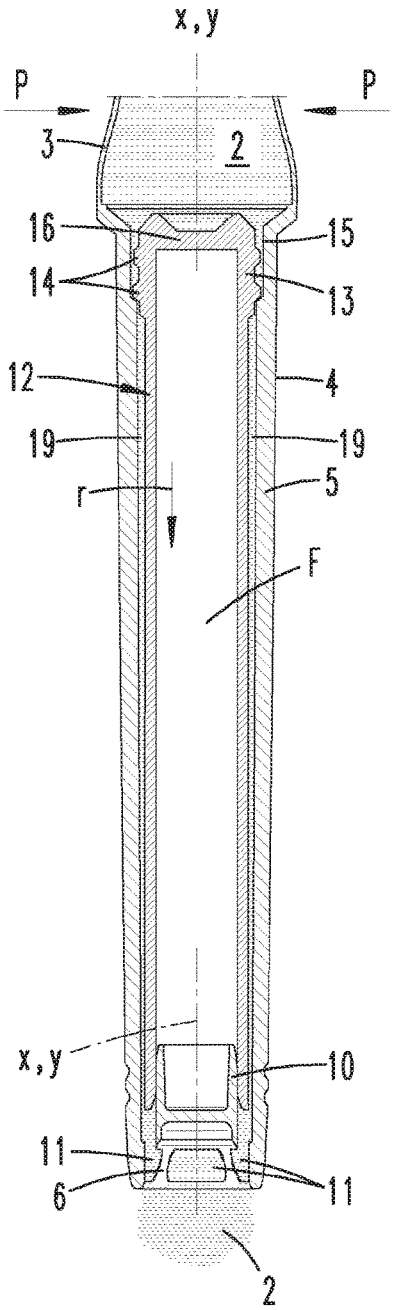
Figure 10:
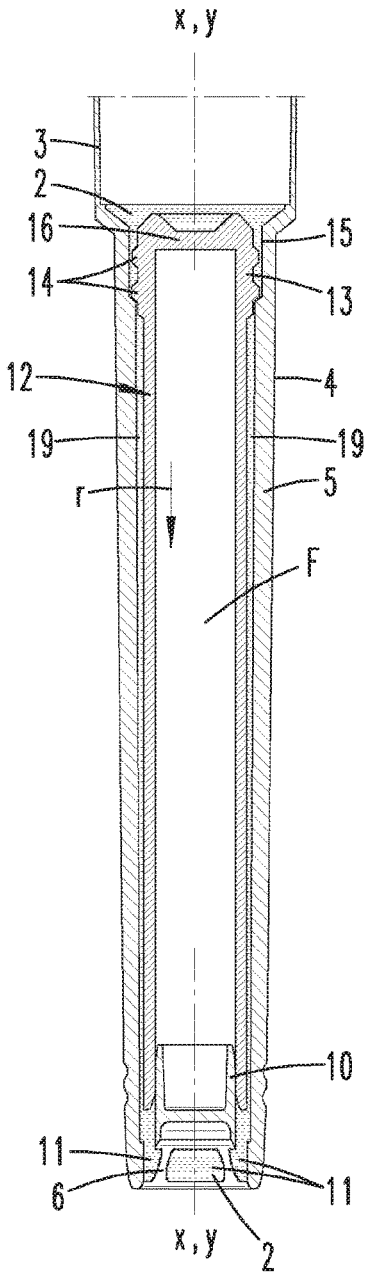
FIG. 10 shows an illustration corresponding to FIG. 9 after the reservoir has been emptied.

The mass 2 is discharged in the mass transport direction r through the mass lines 19, which extend in the direction of the reservoir 3 beyond the engagement region between the insert part 12 and the tube neck 4, and through the dispensing apertures 11 by compressing the reservoir 3 (see arrows P in FIG. 9).

A small residual amount remains in the region of the tube neck 4 after the mass 2 has been discharged.

Figure 11:
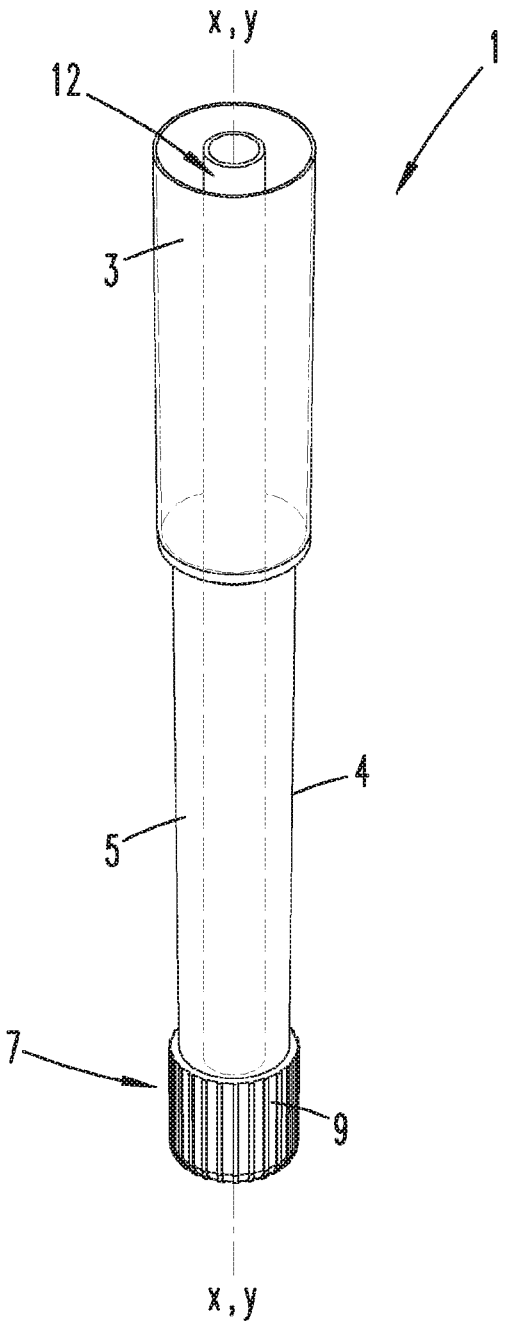
FIG. 11 shows a second embodiment of the plastic tube in the form of an illustration according to FIG. 3.
Figure 12:
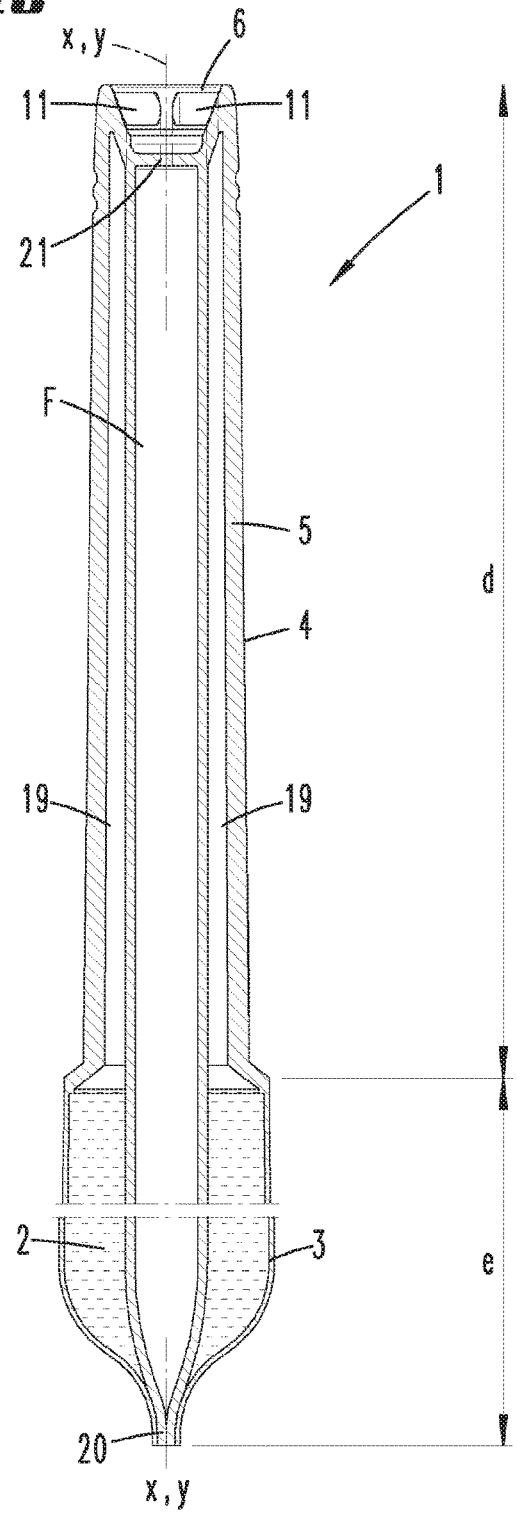
FIG. 12 shows the second embodiment of the plastic tube in the form of a longitudinal section according to FIG. 6.

According to FIGS. 11 and 12, the volume of a tube neck 4 with constant outside diameter and constant wall thickness can also be reduced by means of an insert part 12 formed thereon, i.e. an insert part that is realized integrally with the tube neck 4 and the reservoir 3.

Such an integral insert part 12 is formed on a pot-like connecting section 21, which is reduced axially inward and radially in accordance with the mounting projection 10 of the first embodiment. The dispensing apertures 11 are formed in this connecting section 21 in the region of the pot walls.

The insert part 12 is integrally connected to and consists of the same material as the connecting section 21, wherein said insert part extends concentric to the longitudinal center axis x of the tube neck 4, as well as eccentric to the longitudinal center axis y of the reservoir 3 and also through this reservoir.

The plastic tube 1 is filled in the annular space formed radially outside the insert part 12 in the outside-down position.

During the subsequent closing process, the free end of the insert part 12 facing away from the discharge opening 6 is welded to the wall of the reservoir 3 in the region 20 such that the interior of the insert part (free space F) is in this embodiment also sealed relative to the surrounding space, in which the mass 2 is respectively accommodated or transported.

The preceding explanations serve for elucidating all inventions that are included in this application and respectively enhance the prior art independently with at least the following combinations of characteristics, namely:

A plastic tube, which is characterized in that the tube neck 4 is with respect to a free space, which can be filled with the mass 2 while it is pressed out, designed such that a volume of the mass 2 located in the tube neck 4 while the mass is pressed out corresponds to one-third or less of the volume defined by the dimensions of the tube neck 4.

A plastic tube, which is characterized in that the tube neck 4 features a free space F, which extends in the direction of the longitudinal axis x and is not infiltrated by the mass 2.

A plastic tube, which is characterized in that one or more mass lines 19 are provided.

A plastic tube, which is characterized in that the mass lines are arranged on an annular surface viewed in a cross section.

A plastic tube, which is characterized in that the discharge opening 6 features one or more dispensing apertures 11.

A plastic tube, which is characterized in that a mounting projection 10 extending in the mass transport direction r is formed in the tube neck 4.

A plastic tube, which is characterized in that the mounting projection 10 is arranged on the side of the discharge opening.

A plastic tube, which is characterized in that the mounting projection 10 is realized integrally with and consists of the same material as the tube neck 4.

A plastic tube, which is characterized in that the tube neck 4 can be assembled of multiple parts.

A plastic tube, which is characterized in that an insert part 12 is arranged in the tube neck 4 in order to form a mass line 19.

A plastic tube, which is characterized in that the insert part 12 is mounted on the mounting projection 10 on the side of the discharge opening.

A plastic tube, which is characterized in that the insert part 12 features a mounting projection 13 on the side of the reservoir.

A plastic tube, which is characterized in that the mounting projection 13 is designed for a clamp-type mounting in the tube neck 4.

A plastic tube, which is characterized in that the insert part 12 extends within the tube neck 4 only.

A plastic tube, which is characterized in that the insert part 12 is realized integrally with the tube neck 4.

A plastic tube, which is characterized in that the insert part 12 is connected to the tube neck 4 on the side of the discharge opening.

A plastic tube, which is characterized in that the insert part 12 extends within the tube neck 4, as well as within the reservoir 3.

A plastic tube, which is characterized in that the reservoir has a longitudinal center axis y, and in that the longitudinal center axes x, y of the reservoir 3 and the tube neck 4 coincide.

A plastic tube, which is characterized in that a length of the tube neck 4 in the direction of the longitudinal center axis x is equal to or greater than a longitudinal center axis y of the reservoir 3.

A plastic tube, which is characterized in that the tube neck 4 has a greater wall thickness than the reservoir 3.

A plastic tube, characterized by one or more of the characterizing features of one of the preceding claims.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristic features of the dependent claims characterize independent inventive enhancements of the prior art, particularly in order to submit divisional applications on the basis of these claims.

LIST OF REFERENCE SYMBOLS

1 Plastic tube
2 Mass
3 Reservoir

4 Tube neck
5 Wall
6 Discharge opening
7 Cap
8 Cap top
9 Cap wall
10 Mounting projection
11 Dispensing aperture
12 Insert part
13 Mounting projection
14 Annular rib
15 Localization area
16 Bottom
17 Annular depression
18 Rib
19 Mass line
20 Region
21 Connecting section
a Outside diameter
b Inside diameter
c Outside diameter
d Length
e Length
r Mass transport direction
x Longitudinal center axis
y Longitudinal center axis
F Free space
P Arrow

The invention claimed is:

1. A plastic tube (1) designed for pressing out a liquid to pasty mass (2), comprising a discharge opening (6), a reservoir (3) designed for being compressed and a tube neck (4) connecting the reservoir (3) to the discharge opening (6), wherein a mass line (19) with a line cross section, through which the mass (2) can flow, extends through the tube neck (4), which cannot be used for pressing out the mass (2) by means of manual force of a user, wherein the tube neck (4) features a free space (F), which extends in a direction of a longitudinal axis (x) and is not infiltrated by the mass (2), and wherein the mass line is disposed radially outside of the free space (F).

2. The plastic tube according to claim 1, wherein the tube neck (4) is with respect to a free space, which can be filled with the mass (2) while the mass is pressed out, designed such that a volume of the mass (2) located in the tube neck (4) while the mass is pressed out corresponds to one-third or less of the volume defined by the dimensions of the tube neck (4).

3. The plastic tube according to claim 1, wherein the discharge opening (6) features one or more dispensing apertures (11).

4. The plastic tube according to claim 1, wherein the tube neck (4) can be assembled of multiple parts.

5. The plastic tube according to claim 1, wherein the reservoir (3) has a longitudinal center axis (y), and wherein the longitudinal center axis (y) of the reservoir (3) and the longitudinal axis (x) of the tube neck (4) coincide.

6. The plastic tube according to claim 1, wherein the tube neck (4) has a greater wall thickness than the reservoir (3).

7. A plastic tube (1) designed for pressing out a liquid to pasty mass (2), comprising a discharge opening (6), a reservoir (3) designed for being compressed and a tube neck (4) connecting the reservoir (3) to the discharge opening (6), wherein multiple mass lines (19) are provided, each mass line having a line cross section, through which the mass (2) can flow, the mass lines extending through the tube neck (4), which cannot be used for pressing out the mass (2) by means of manual force of a user, and wherein the tube neck (4) features a free space (F), which extends in a direction of a longitudinal axis (x) and is not infiltrated by the mass (2).

8. The plastic tube according to claim 7, wherein the mass lines (19) are arranged in an annular surface viewed in a cross section.

9. A plastic tube (1) designed for pressing out a liquid to pasty mass (2), comprising a discharge opening (6), a reservoir (3) designed for being compressed and a tube neck (4) connecting the reservoir (3) to the discharge opening (6), wherein a mass line (19) with a line cross section, through which the mass (2) can flow, extends through the tube neck (4), which cannot be used for pressing out the mass (2) by means of manual force of a user, wherein the tube neck (4) features a free space (F), which extends in a direction of a longitudinal axis (x) and is not infiltrated by the mass (2), and wherein a mounting projection (10) extending in a mass transport direction (r) is formed in the tube neck (4).

10. The plastic tube according to claim 9, wherein the mounting projection (10) is arranged on a side of the discharge opening.

11. The plastic tube according to claim 9, wherein the mounting projection (10) is realized integrally with and consists of a same material as the tube neck (4).

12. The plastic tube according to claim 9, wherein an insert part (12) is arranged in the tube neck (4) in order to form the mass line (19).

13. The plastic tube according to claim 11, wherein the insert part (12) is mounted on the mounting projection (10) on the side of the discharge opening.

14. The plastic tube according to claim 11, wherein the insert part (12) features a second mounting projection (13) on a side of the insert facing the reservoir.

15. The plastic tube according to claim 14, wherein the second mounting projection (13) is designed for a clamp mounting in the tube neck (4).

16. The plastic tube according to claim 11, wherein the insert part (12) is realized integrally with the tube neck (4).

17. The plastic tube according to claim 11, wherein the insert part (12) is connected to the tube neck (4) on the side of the discharge opening.

18. The plastic tube according to claim 12, wherein the insert part (12) extends within the tube neck (4) only.

19. The plastic tube according to claim 11, wherein the insert part (12) extends within the tube neck (4), as well as within the reservoir (3).

20. The plastic tube according to claim 5, wherein a length of the tube neck (4) in the direction of the longitudinal axis (x) is equal to or greater than a length of the reservoir (3) in a direction of the longitudinal center axis (y).

* * * * *